US005465078A

United States Patent [19]

Jones, Jr.

[11] Patent Number: 5,465,078

[45] Date of Patent: Nov. 7, 1995

[54] MAGNETIC DRAIN BOLT

[75] Inventor: James D. Jones, Jr., Palatine, Ill.

[73] Assignee: Illinois Tool Works Inc., Glenview, Ill.

[21] Appl. No.: 392,522

[22] Filed: Feb. 23, 1995

[51] Int. Cl.[6] ..... H01F 7/02

[52] U.S. Cl. ..... 335/305; 184/6.25

[58] Field of Search ..... 335/302–306; 600/11; 210/222, 223; 184/6.25; 7/901; 227/113; 292/251.5

[56] References Cited

U.S. PATENT DOCUMENTS

| | | | |
|---|---|---|---|
| 1,281,842 | 10/1918 | Rosnick et al. . | |
| 2,242,830 | 5/1941 | Lisle | 209/215 |
| 2,755,932 | 7/1956 | Cohn | 210/1.5 |
| 2,870,384 | 1/1959 | Brooks | 317/201.5 |
| 3,370,144 | 2/1968 | Arthur et al. | 210/222 |
| 3,800,914 | 4/1974 | Miyata | 184/6.25 |
| 4,810,148 | 3/1989 | Aisa et al. | 411/383 |
| 4,834,464 | 5/1989 | Frehse | 301/108 |
| 5,089,129 | 2/1992 | Brigman | 210/223 |
| 5,150,769 | 9/1992 | Major et al. | 184/31 |
| 5,150,975 | 9/1992 | Major et al. | 384/465 |
| 5,314,625 | 5/1994 | Farnelli | 210/695 |

*Primary Examiner*—Leo P. Picard
*Assistant Examiner*—Raymond M. Barrera
*Attorney, Agent, or Firm*—Thomas W. Buckman; Mark W. Croll; John P. O'Brien

[57] ABSTRACT

A magnetic drain bolt comprising a bolt body and a magnet. The bolt body comprises of a male-threaded member and a head member, the male-threaded member having a fastening protuberance formed at an end thereof. The magnet is comprised of a sintered ferrite material and has a recess formed at a bottom end thereof for receipt of the fastening protuberance, the recess having a depth sized equivalent to a height of the fastening protuberance, the magnet having a diameter slightly smaller than a diameter of the male-threaded member. The fastening protuberance is secured with an adhesive to the magnet within the recess whereby the fastening protuberance provides additional support for securing the magnet to the bolt body.

10 Claims, 1 Drawing Sheet

MAGNETIC DRAIN BOLT

BACKGROUND OF THE INVENTION

1. Field of the Invention

The present invention relates generally to an improved, low cost magnetic drain bolt, and more particularly to a drain bolt having a magnet attached at the end thereof for attracting metallic particles in an oil pan of an automobile to prevent the metallic particles from interfering with sensors within the engine.

2. Description of the Prior Art

In an automobile engine, oil circulates between the engine, a reservoir and an oil pan. Oil is used to lubricate the engine to diminish the friction between the piston and the cylinder. This friction can cause small metal shavings and other debris to circulate in the oil. The oil is also used to convey heat and debris from the engine. An oil filter is typically used in the circulation path of the oil to filter out debris and particles in the oil. However, small metal shavings in the oil are not always filtered and cannot only cause excessive wear on the engine, but can also disrupt sensors that are now found in the engines of many vehicles, such as a crank shaft position sensor. These sensors can give false readings if too many metal shavings and particles come into contact with the sensor. It is therefore desirable to provide a method of removing such particles from the oil to prevent excessive wear on the engine and to enable the sensors in the engine to work properly.

One solution is to provide a magnetic drain plug positioned in the plug hole of an oil pan. Different types of magnetic drain plugs exist, however, they are either not strong enough to attract the metal shavings and particles in the oil or they are too costly to manufacture.

Conventional magnetic drain bolts typically have a magnet inserted into a recess on the bolt. By making a magnetic drain bolt with a recess in the bolt body, an additional step would be required in the manufacturing process to drill a recess in every bolt, thereby increasing the cost of the magnetic drain bolt. Furthermore, these types of drain bolts have magnets that extend from the recess of the bolt body an excessive distance beyond the normal length of a regular drain bolt thereby providing a magnetic drain bolt that has a longer length than a standard, non-magnetic drain bolt. Other magnetic types drain bolts disclose the use of different types of magnets, such as synthetic resin, rare earth or ceramic type magnets. These types of magnets are more expensive than sintered ferrite magnetic materials and further increase the cost of the magnetic drain bolt.

Conventional magnetic drain bolts can initially have a strong magnetic force when first magnetized. After the magnetic drain bolts come into contact with other magnetic drain bolts and/or magnets, the magnetic force of the drain bolt is "knocked down" and becomes weaker. Such conventional magnetic drain bolts are typically knocked down during the shipping process and can degrade from 40–60 percent, thereby ultimately providing a much weaker drain bolt than initially created and therefore not providing the magnetic force necessary to attract metallic particles and shavings in an oil pan of an engine.

These and other types of magnetic drain bolts disclosed in the prior art do not offer the flexibility and inventive features of the magnetic drain bolt described herein. As will be described in greater detail hereinafter, the magnetic drain bolt of the present invention differs from those previously proposed.

It therefore would be desirable to provide a low cost magnetic-drain bolt that is similar in size and length to a non-magnetic drain bolt, easy to manufacture, less expensive to manufacture, degrades less than conventional magnetic drain bolts after being knocked down and still provides a strong magnetic attraction in order to attract metallic shavings and particles in an oil pan of an engine.

SUMMARY OF THE INVENTION

According to the present invention I have provided a magnetic drain bolt comprising: a bolt body, the bolt body comprising a male-threaded member and a head member, the male-threaded member having a fastening protuberance formed at an end thereof; and a magnet; the magnet comprising a sintered ferrite material, the magnet having a recess formed at a bottom end thereof for receipt of the fastening protuberance, the recess having a depth equivalent to a height of the fastening protuberance, the magnet having a diameter slightly smaller than a diameter of the male-threaded member, the fastening protuberance being secured with an adhesive to the magnet within the recess whereby the fastening protuberance provides additional support for securing the magnet to the bolt body.

Another feature of my invention relates to the process of making a magnetic drain bolt, which comprises the steps of: forming a bolt body with a male-threaded member and a head member, the male-threaded member being formed with a fastening protuberance at an end thereof, forming a sintered ferrite slug of a magnetizable material with a recess formed at one end thereof, the recess being formed a depth sized equivalent to a height of the fastening protuberance on the bolt body and with a diameter slightly smaller than a diameter of the male-threaded member of the bolt body; securing the fastening protuberance of the bolt body within the recess of the sintered ferrite slug with an adhesive to secure the sintered ferrite slug in assembly with the bolt body; and then magnetizing the sintered ferrite slug.

Yet another feature of my invention concerns the magnetic drain bolt described above wherein a top end of the magnet opposite the recess is magnetized in such a manner that the top end has opposite magnetic polarities thereon.

DESCRIPTION OF THE DRAWINGS

Various objects, features and attendant advantages of the present invention will become more fully appreciated and more readily apparent from the following detailed description, when considered in connection with the accompanying drawings, in which like reference characters designate like or corresponding parts throughout the several views, and wherein.

DESCRIPTION OF THE PREFERRED EMBODIMENTS

Figure 1:
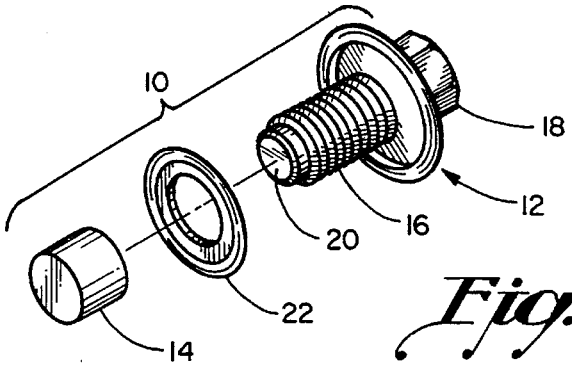
FIG. 1 is a perspective exploded view of the magnetic drain bolt embodying important features of my invention.
Figure 2:
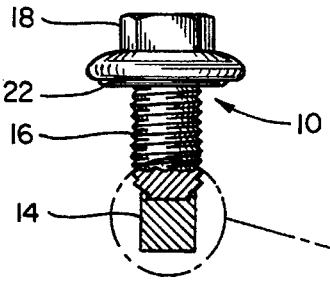
FIG. 2 is a side view, partially cut away, showing how the magnet is attached to the drain bolt.

Referring now to the drawings, FIGS. 1 and 2 show my new and improved magnetic drain bolt 10. The magnetic drain bolt comprises a steel bolt body 12 and a magnet 14. The bolt body 12 comprises a male-threaded member 16 and a hexagonal head member 18. A fastening protuberance 20 is formed at one end of the male-threaded member 16 opposite the hexagonal head member 18. An O-ring seal 22 can additionally be used with the magnetic drain bolt 10 to provide additional sealing protection when fastening the magnetic drain bolt 10 to an oil pan of an engine.

Figure 3:
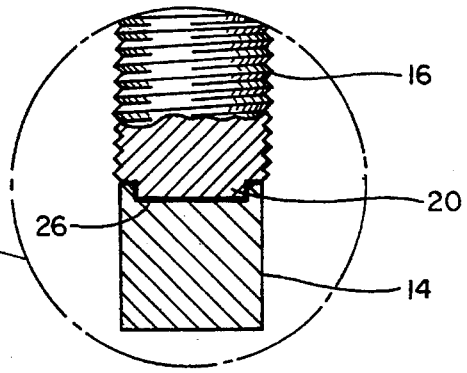
FIG. 3 is an enlarged view of the encircled area A of FIG. 2.
Figures 4, 5:
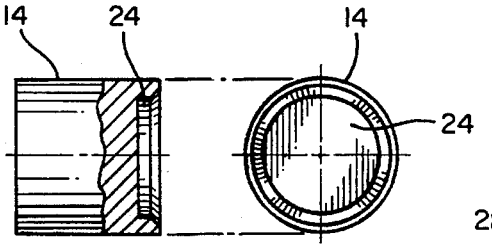
FIG. 4 is a side view, partially cut away, of the drain bolt magnet.
FIG. 5 is a bottom plan view of the drain bolt magnet shown in FIG. 4.

The magnet 14 shown in FIGS. 3, 4 and 5 is made of a sintered ferrite material. Excellent results can be obtained by using a sintered aluminum-nickel-cobalt material known as "sintered alnico/8" manufactured by Arnold Engineering in Marengo, Ill. It is contemplated that other magnetic materials can also be used such as synthetic resins, ceramics, rare earth and others, however, they are more expensive than sintered ferrite materials and would increase the cost of the magnetic drain bolt.

Referring to FIGS. 4 and 5, the magnet 14 is formed into a cylindrical shape having recess 24 at a bottom end. The sintered aluminum-nickel-cobalt material can be press formed into the shape required for the embodiment shown in FIGS. 4 and 5. The diameter of the magnet 14 is sized slightly smaller than the diameter of the male-threaded member 16. The depth of the recess 24 should not exceed 20 percent of the height of the magnet since the sintered ferrite material may not properly form. The depth of the recess 24 in the magnet 14 is equivalent to the height of the fastening protuberance 20 on the male-threaded member 16. The fastening protuberance 20 is secured to the magnet 14 within the recess 24 with an adhesive 26. An adhesive is used to secure the magnet 14 to the bolt body 12 since other fastening methods such as screwing, crimping and forcing the magnet into place could damage the magnet and therefore ground the magnet out and provide a much weaker magnetic attraction on the drain bolt.

Standard non-magnetic drain bolts have a pilot member extended at the end of the threaded portion on the drain bolt to help guide the drain bolt into the oil pan hole. The pilot member is not threaded and is slightly smaller in diameter than the bolt body. The magnet 14 in this magnetic drain bolt 10 is positioned in the place of the pilot member on typical non-magnetic drain bolts, therefore, there would be no increased length and size of the magnetic drain bolt 10 as compared to standard, non-magnetic drain bolts. Excellent results are obtained when the magnet has a height of 7.5 mm to 8 mm.

The magnet 14 is magnetized after it is secured to the bolt body 12. Attaching a non-magnetized magnet to the bolt body 12 provides a much easier manufacturing process since the magnets do not need to be individually separated from other magnets due to their magnetic attraction to each other. This enables the magnetic drain bolts to be manufactured quicker, easier and at a lower cost by not having to separate unattached magnets from each other.

The magnetic drain bolt 10 is magnetized by touching the magnet on the end of the drain bolt to a magnetic transducer. The magnet 14 on the magnetic drain bolt 10 is magnetized in such a manner that the top end opposite the recess has opposite magnetic polarities placed thereon, thereby,providing north and south polarities on the top end of the magnet 14. This provides a stronger magnetic attraction of the magnet 14 versus magnetizing the magnet to have opposite polarities on the top and bottom of the magnet.

The magnetic force of the magnetic drain bolt 10 degrades only 20–25 percent when the magnet is "knocked down⇆ as compared to conventional magnetic drain bolts that degrade 40–60 percent after being knocked down. The magnetic drain bolts will typically be knocked down during the shipping process by the magnets touching other magnets. Eventually all the magnets on the drain bolts would be knocked down since normal use and contact with metallic objects will also knock down the magnet. The magnetic drain bolt 10 as herein disclosed maintains a high magnetic attraction after being knocked down. The knocked down magnetic force of a magnetic drain bolt as herein described with a magnet having a diameter of 9 mm and a height of 7.5 mm is over 600 gausses.

Figure 6:
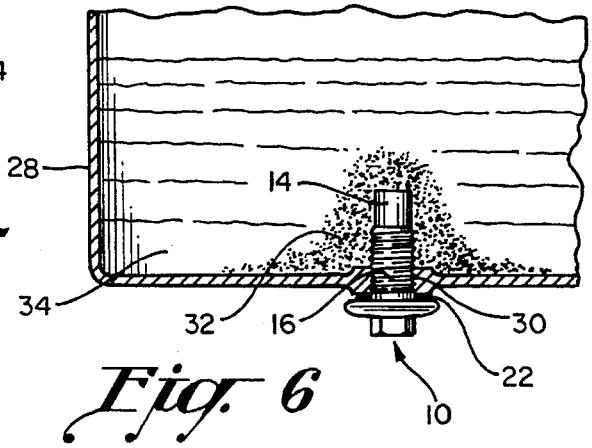
FIG. 6 is a cross-sectional view showing the magnetic drain bolt positioned in an oil pan of an engine.

Referring to FIG. 6, the magnetic drain bolt 10 is inserted into an oil pan 28 of an engine by first guiding the magnetic drain bolt 10 with the magnet 14 into a tapped hole 30 on the bottom of the oil pan 28 and then screwing the male-threaded member 16 into the tapped hole 30. The magnetic drain bolt is then tightened in place with a wrench fitted over the hexagonal head member 18 and is sealed with the O-ring seal 22. The magnetic drain bolt 10 is then in place to attract metallic particles and shavings 32 circulating in the oil 34 thereby preventing metallic particles and shavings from interfering with sensors located within the engine.

When the engine oil is replaced and/or drained, the magnetic drain bolt 10 is removed and is then wiped off with a towel or a rag to remove the metallic particles and shavings that were attached to the magnet 14. After the engine oil has been drained, the magnetic drain bolt 10 is then inserted back into the oil pain to continue to attract metallic particles and shavings.

Modifications and variations of the present invention are possible in light of the above teachings. It therefore is to be understood that within the scope of the appended claims, the invention may be practiced otherwise than as specifically described.

What is claimed and desired to be secured by Letters Patent is:

1. A magnetic drain bolt comprising:

a bolt body, said bolt body comprising of a male-threaded member and a head member, said male-threaded member having a fastening protuberance formed at an end thereof;

a magnet; said magnet having a recess formed at a bottom end thereof for receipt of said fastening protuberance, said recess having a depth sized equivalent to a height of said fastening protuberance, said magnet having a diameter slightly smaller than a diameter of the male-threaded member; and attachment means securing said fastening protuberance to the magnet within said recess whereby the fastening protuberance provides additional support for securing the magnet to the bolt body.

2. The magnetic drain bolt of claim 1, wherein the magnet comprises a sintered ferrite material.

3. The magnetic drain bolt of claim 2, wherein the sintered ferrite material comprises a sintered aluminum-nickel-cobalt material.

4. The magnetic drain bolt of claim 1, wherein said attachment means comprises an adhesive which secures said fastening protuberance within said recess.

5. The magnetic drain bolt of claim 1, wherein a top end of the magnet opposite the recess is magnetized in such a manner that the top end has opposite magnetic polarities thereon.

6. The magnetic drain bolt of claim 1, wherein said magnetic drain bolt further comprises an O-ring seal, said O-ring seal having an inner diameter sized to fit about the diameter of the male-threaded member and an outer diameter sized slightly smaller than a diameter of the head member, said O-ring seal being positioned about the male-threaded member and against the head member for sealing the magnetic drain bolt when secured to an oil pan of an engine.

7. In combination, a drain bolt and a sintered ferrite magnet, said drain bolt comprising:

a bolt body, said bolt body comprising of a male-threaded member and a head member, said male-threaded member having a fastening protuberance formed at an end thereof;

said sintered ferrite magnet having a recess formed at a bottom end thereof for receipt of said fastening protuberance, said recess having a depth sized equivalent to a height of said fastening protuberance, said sintered ferrite magnet having a diameter slightly smaller than a diameter of the male-threaded member, said fastening protuberance being secured with an adhesive to the sintered ferrite magnet within said recess whereby the fastening protuberance provides additional support for securing the sintered ferrite magnet to the drain bolt.

8. A process of making a magnetic drain bolt comprising the steps of:

forming a bolt body with of a male-threaded member and a head member, the male-threaded member being formed with a fastening protuberance at an end thereof, forming a sintered ferrite slug of a magnetizable material with a recess formed at one end thereof, the recess being formed having a depth equivalent to a height of the fastening protuberance on the bolt body and with a diameter slightly smaller than a diameter of the male-threaded member of the bolt body;

securing said fastening protuberance of the bolt body within the recess of the sintered ferrite slug with an adhesive to secure the sintered ferrite slug in assembly with the bolt body; and magnetizing the sintered ferrite slug.

9. The process of making a magnetic drain bolt as claimed in claim 8, wherein the magnetization of the sintered ferrite slug includes touching the sintered ferrite slug to a magnetic transducer.

10. The process of making a magnetic drain bolt as claimed in claim 8, wherein the magnetization of the sintered ferrite slug includes magnetizing a top end of the magnet opposite the recess in such a manner that the top end has opposite magnetic polarities thereon.

* * * * *